US006588318B2

(12) United States Patent
Aday et al.

(10) Patent No.: US 6,588,318 B2
(45) Date of Patent: Jul. 8, 2003

(54) HYDRAULIC RETENTION SYSTEM FOR RECIPROCATING PUMP CYLINDER LINER

(75) Inventors: James C. Aday, McAlester, OK (US); Mark A. Staggs, McAlester, OK (US)

(73) Assignee: National-Oilwell, L.P., Houston, TX (US)

( * ) Notice: Subject to any disclaimer, the term of this patent is extended or adjusted under 35 U.S.C. 154(b) by 0 days.

(21) Appl. No.: 09/802,761

(22) Filed: Mar. 9, 2001

(65) Prior Publication Data

US 2002/0124720 A1 Sep. 12, 2002

(51) Int. Cl.[7] ..... F01B 11/02
(52) U.S. Cl. ..... 92/171.1; 29/888.061
(58) Field of Search ..... 92/171.1; 29/128, 29/888.021, 888.061

(56) References Cited

U.S. PATENT DOCUMENTS

| | | | | |
|---|---|---|---|---|
| 2,845,313 A | | 7/1958 | Benson et al. | |
| 2,963,984 A | | 12/1960 | Rogers | |
| 3,438,334 A | | 4/1969 | Schaaf | 103/216 |
| 3,610,110 A | | 10/1971 | Schaaf | 92/169 |
| 3,635,616 A | | 1/1972 | Venkatesan | 425/77 |
| 3,786,729 A | | 1/1974 | Rizzone | 92/171 |
| 4,453,454 A | | 6/1984 | Comer | 92/82 |
| 4,486,938 A | | 12/1984 | Hext | 29/402.06 |
| 4,550,646 A | * | 11/1985 | Miller | 92/171.1 |
| 5,307,915 A | | 5/1994 | Grosspietsch et al. | 192/98 |
| 5,359,824 A | | 11/1994 | Koberstein | 52/507 |
| 5,572,920 A | | 11/1996 | Kennedy et al. | 92/128 |
| 5,616,009 A | | 4/1997 | Birdwell | 417/342 |
| 6,209,445 B1 | * | 4/2001 | Roberts et al. | 92/128 |

OTHER PUBLICATIONS

PCT Search Report in PCT/US02/05533.3 dated Oct. 21, 2002.

* cited by examiner

*Primary Examiner*—Edward K. Look
*Assistant Examiner*—Igor Kershteyn
(74) *Attorney, Agent, or Firm*—Conley Rose, P.C.

(57) ABSTRACT

A hydraulic system is provided for securing a cylinder liner to a pump module of a reciprocating pump, such as a mud pump. The hydraulic system includes a body attached to the pump module, a ram in sliding contact with the body and having a mating surface, preferably a radial shoulder, contacting the liner. Upon pressurization of fluid in a chamber defined by the body, the ram, and a pair of seals therebetween, the ram slides between a first position and a second position. The ram secures the liner to the module when in the first position and is removable in the second position. The system further includes a locking ring that engages the body, may be hand rotated upon pressurization, and mechanically holds the ram in the first position in the absence of hydraulic pressure. The hydraulic system is adapted to apply a precise axial securing force and to aid alignment of the liner.

19 Claims, 4 Drawing Sheets

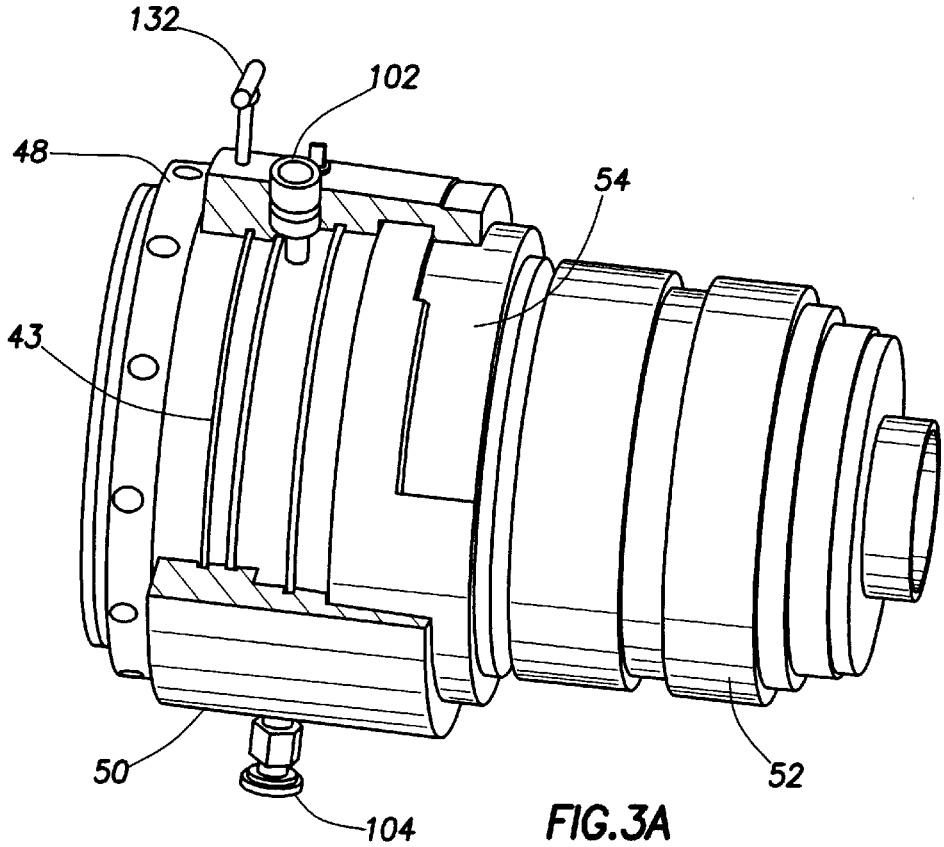
FIG.3A
FIG.3B
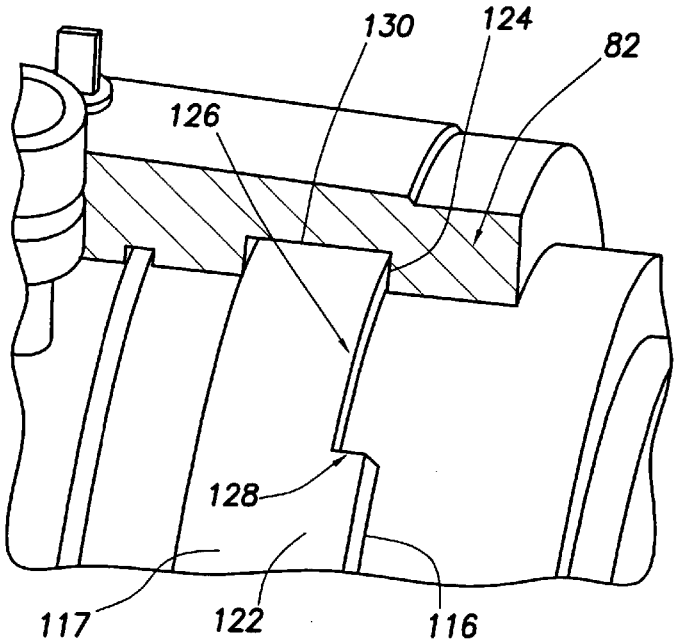

HYDRAULIC RETENTION SYSTEM FOR RECIPROCATING PUMP CYLINDER LINER

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates generally to mud pumps and particularly relates to a system and apparatus for aligning and securing the cylinder liners of such pumps to their respective pumping modules. More particularly, the present invention relates to a hydraulic retention system and apparatus for aligning and securing the cylinder liner. Still more particularly, the system and apparatus include a positive metal to metal locking feature.

BACKGROUND OF THE INVENTION

In extracting hydrocarbons, such as oil and gas, from the earth, on land and subsea, it is common to drill a wellhole into the earth formation containing the hydrocarbons. A drill bit is attached to a drill string, including joined sections of drill pipe, suspended from a drilling rig. As the drill bit rotates, the hole deepens and the string is lengthened by attaching additional sections of drill pipe. During drilling operations, drilling fluid, or "mud" as it is also known, is pumped down through the drill pipe and into the hole through the drill bit. Drilling fluids are used to lubricate the drill-bit and keep it cool. The drilling mud also cleans the bit, and balances pressure by providing weight downhole, as well as bringing up sludge and cuttings from the drilling process to the surface.

Slush or mud pumps are commonly used for pumping the drilling mud. Because of the need to pump the drilling mud through several thousand feet of drill pipe, such pumps typically operate at very high pressures. Moreover, it is necessary for the mud to emerge from the drill bit downhole at a relatively high velocity to lubricate and cool the bit and to effectively remove cuttings from the hole. Lastly, the pressure generated by the mud pump contributes to maintaining a predetermined total downhole pressure, which is necessary to prevent well blowouts.

The pistons and cylinders used for such mud pumps are susceptible to a high degree of wear during use because the drilling mud is relatively dense and has a high proportion of suspended abrasive solids. As the cylinder becomes worn, the small annular space between the piston head and the cylinder wall increases substantially and sometimes irregularly. This decreases the efficiency of the pump. To reduce the effect of this wear, the cylinder typically is provided with a replacable cylinder liner.

It is the usual practice to replace the cylinder liner at end of its useful life. The pump cylinder liner in a duplex pump typically has an average life of 1200 to 1500 pump hours, or about 90 to 100 days. A duplex pump has two reciprocating pistons that each force fluid into a discharge line. The average life of the cylinder liners in a triplex pump is about 500 to 900 hours or about 50 to 60 days of service life at a normal duty cycle. Triplex reciprocating pumps have three pistons that force fluid into a discharge line. These fluid pumps can be single acting, in which fluid is discharged on alternate strokes, or double acting, in which each stroke discharges fluid.

In the course of installing or replacing a cylinder liner, the cylinder liner may become misaligned. Misaligned contact between the metal piston head and the cylinder creates considerable friction, abrasion, and heat. This, in turn, causes the cylinder liner, as well as other various pump parts, such as seals, to be susceptible to an increased rate of wear. In some cases, the frictional forces may even cause the seal to detach from the piston. For these reasons, the alignment of the cylinder liner of such pumps is critical.

Further, changing a cylinder liner in a mud pump is typically a difficult, dirty, and heavy job. Still further, because drilling rig time is very expensive, frequent replacement of cylinder liners causes considerable inconvenience if the system and apparatus for releasing the old cylinder liners and fitting the replacement cylinder liners are slow or difficult to operate. Thus, it is important that the system and method for aligning and securing the cylinder liners may be implemented without undue effort and down-time.

Some original pump designs include a large threaded sledge hammer nut that is hammered on and off to hold the liner in place. Such a system for securing cylinder liners to respective pumping modules is difficult to operate for a variety of reasons, including the involvement of heavy components, the handling of which may be dangerous for operators. These types of systems require considerable strength, skill and reliability of operators, together with the use of heavy tools in confined spaces. Thus, it is difficult to apply a specified torque to within a desired preset tolerance. Further, the securing force is dependent on the extent of wear and the general condition of the securing components.

There are several alternative ways to attach cylinder liners to their respective pumping modules and these may vary according to make of pump in which they are used. One embodiment presently known employs a tapered concentric clamp, while another uses a concentric screw clamping arrangement. The tapered clamp is susceptible to corrosion and wear, which diminish its effectiveness. Other pump designs require large wrenches or impact socket tools to remove large nuts from studs so as to release the retainer. Not only is this not an precise way to load the liner seal, but in some models the rotation effect can dislodge and fail the seal mechanism. In all of these systems, the force securing the cylinder liner is difficult to control, causing the cylinder liner to be susceptible to misalignment.

In still another known design, a replacement device involves removal of some of the original parts and uses hydraulics and belville washers to load, hold, and restrain the liner. This system relies on a spring lock, and therefore the securing force is dependent on the ability of the spring to retain its stiffness against the securing components. In addition, it relies on nuts secured on studs spaced about the circumference of the cylinder. Thus, this system causes the cylinder liner to be susceptible to misalignment arising from unequal securing forces at each stud, which can be caused by unequal tightening of each nut.

Notwithstanding the above teachings, there remains a need to develop a new and improved system and apparatus for retaining and replacing a cylinder liner which overcomes the foregoing difficulties while providing more advantageous overall results.

SUMMARY OF THE INVENTION

The present invention features a hydraulic retention system that includes a hydraulic body attached to the pump module. The body surrounds a hydraulic ram, which bears on the cylinder liner and is adapted to impart a securing force to the cylinder liner. The ram has a secured position achieved upon pressurization of hydraulic fluid contained in a chamber defined between the body and the ram. In the absence of hydraulic pressure, the ram is mechanically held in the secured position by a locking member that engages the body.

The present system provides a metal to metal lock and promotes alignment. The present system makes the task of changing liners easier and much safer due to the lack of a need for high power or dangerous tools, such as sledge hammers. The hydraulic hand pump utilized in the present system is easy and safe, and features precise securing forces. The liner alignment is a advantage of these machines and this design is an improvement on previously known designs.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIG. 3A is a partially cut-away view of a portion of the system shown in FIG. 3; and FIG. 3B is an enlarged perspective view of the system shown in FIG. 3A.

DETAILED DESCRIPTION OF THE PREFERRED EMBODIMENT

Figure 1:
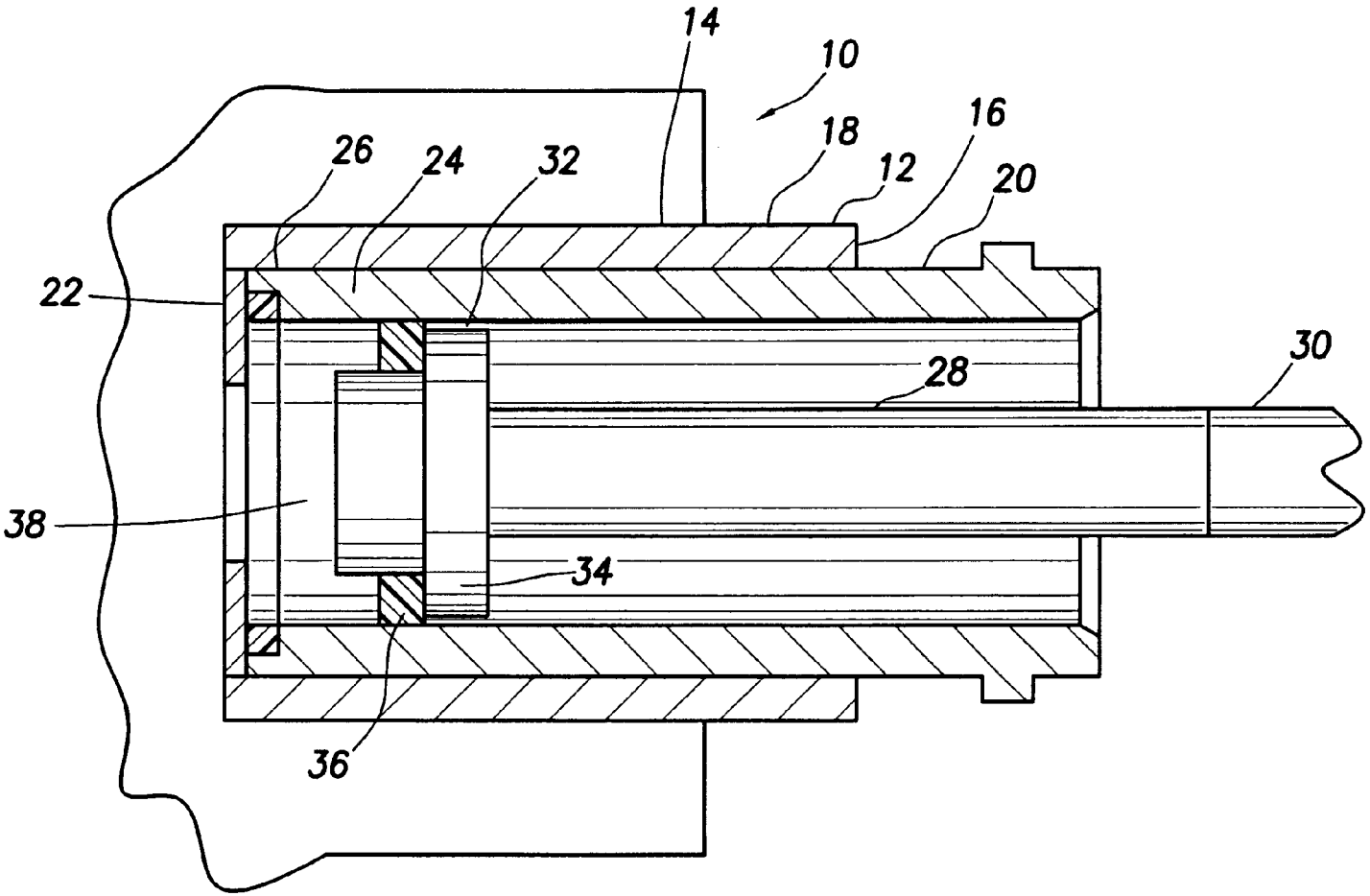
FIG. 1 (PRIOR ART)
FIG. 1 is a cross-sectional view of the fluid end of a conventional pump module.

The design of mud pump modules is known to one of ordinary skill in the art, for example as disclosed in U.S. Pat. Nos. 4,486,938 and 5,616,009, each hereby incorporated herein by reference. Referring to FIG. 1, an exemplary prior art mud pump 10 includes retention member 12. Retention member 12 preferably comprises a substantially cylindrical retention sleeve 14 that includes a front face 16 and an outer surface 18. Retention member 12 optionally includes a centering sleeve (not shown) lining the inner surface of the retention sleeve 14. A cylinder liner 20 is disposed within retention member 12, preferably contacting the inner surface of retention member 12. A wear plate 22 provides a renewable surface for liner 20. A liner seal 26 is preferably positioned between end 24 of cylinder liner 20 and wear plate 22. A piston 28 is disposed within liner 20 and is connected to a rod 30 which, in turn, is connected to a slider crank mechanism (not shown) driven by an electric motor or engine (not shown). In operation, the piston 28 reciprocates within liner 20. The orientation of the piston 28 may be reversed from that shown in FIG. 1, depending on the configuration of the pump. Between the cylinder liner 20 and the piston 28 is a small annular space 32. The piston 28 includes a piston head 34 having an annular seal 36 is disposed thereon. Seal 36 contacts the inside of cylinder liner 20. Pump fluid is located in chamber 38 defined by liner 20, piston 28, and wear plate 22. Chamber 38 is in fluid communication with a passageway (not shown) through a pump manifold (not shown). The pump fluid is pressurized by the movement of the piston 28 within the liner 20. Seal 36 is provided to seal the annular space 32 and thereby prevent the fluid from leaking behind piston head 34. Seal 36 also preferably helps keep the piston 28 centered so as to maintain the annular space 32 separating piston 28 from cylinder liner 20. In operation, piston 28 and liner 20 will become worn, particularly if piston 28 and liner 20 come into contact as a result of misalignment. At some point, the degree of wear will be so great that operation of the pump will be impaired. For this reason, it is desirable to have a liner retention system that is reliable and easy to install, operate, and remove.

Figure 2:
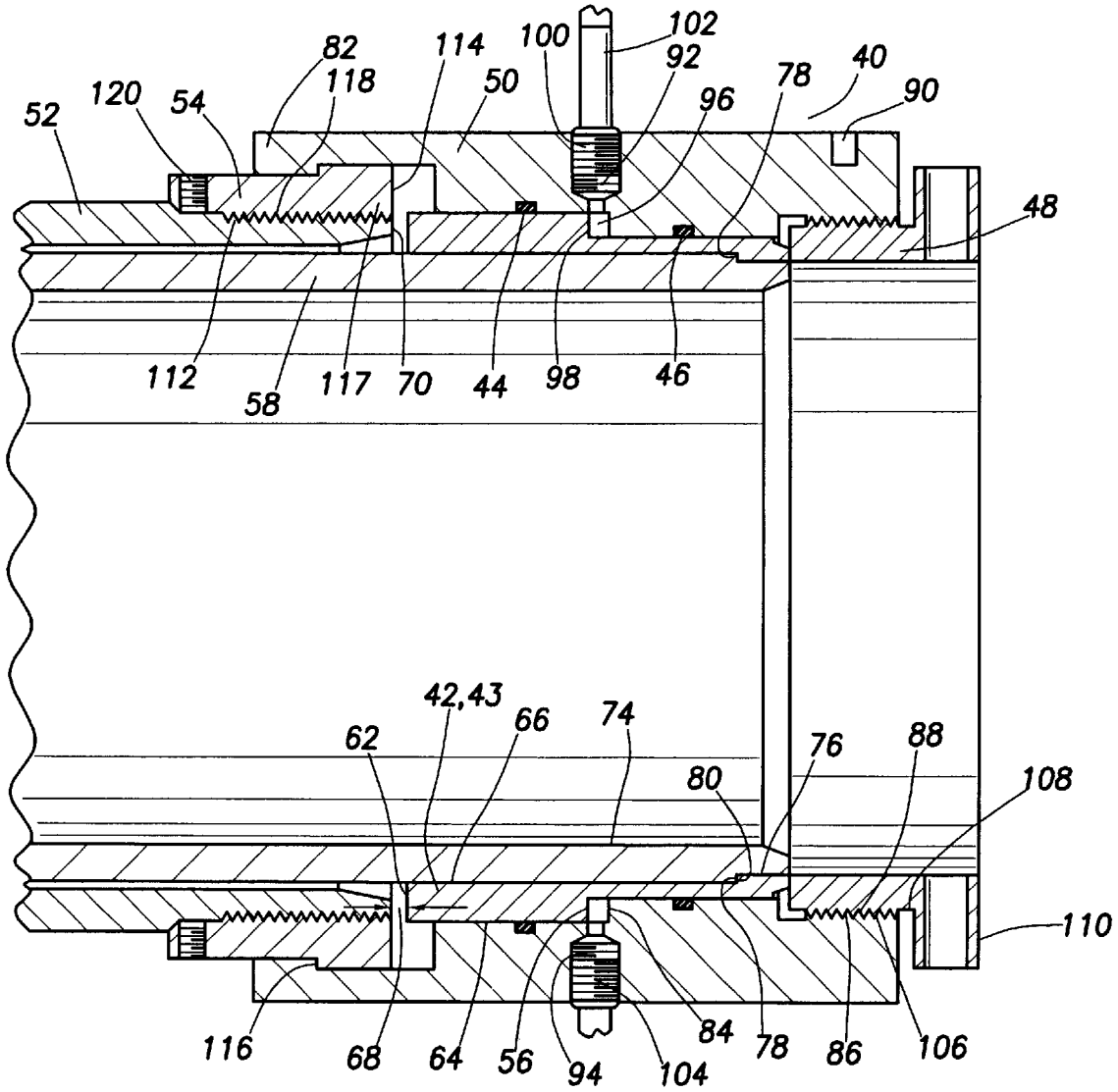
FIG. 2 is a cross-sectional view of a hydraulic retention system according to a preferred embodiment.

Referring now to FIG. 2, a preferred hydraulic retention system 40 that may be used to replace prior liner retention systems in known mud pumps, such as described above, includes a slidable member 42, a pair of seals 44, 46, a locking member 48, a body 50 and a retention member 52. A lug adapter 54 preferably is disposed between retention member 52 and body 50, and attaches body 50 to retention member 52. Slidable member 42 is in slidable contact with body 50 and has an unsecured position and a secured position. The slidable member 42 is shown in the unsecured position in FIG. 2. Seals 44, 46 are disposed around slidable member 42 and seal the interface between slidable member 42 and body 50. The first seal 44 is located inwardly of shoulder 56 and the second seal 46 is located outwardly of a shoulder 56.

Slidable member 42 is preferably in the form of a hydraulic ram 43. Hydraulic rams are known in the art, and may take a number of forms. In a preferred embodiment ram 43 is disposed around liner 58, and preferably extends circumferentially around the liner 58. Ram 43 includes a back face 62, an outer surface 64, and an inner surface 66. A gap 68 is defined between back face 62 and the front face 70 of retention member 52. Preferably, gap 68 is from about ⅛ to about 1/16 inch wide when the slidable member 42 is in the unsecured position. When the slidable member 42 is in the secured position (not shown) gap 68 is smaller. Outer surface 64 includes outer annular shoulder 56. Inner surface 66 includes a first diameter portion 74, a second, smaller diameter portion 76, and an inner annular shoulder 78 therebetween. Inner annular shoulder 78 engages a corresponding lip 80 on liner 58. This orientation of the mating surface 78 has the advantage that force transmitted between ram 43 and liner 58 is substantially axial, compelling liner 58 axially towards the module. This has the advantage of aiding the desired alignment of liner 58. Liner 58 is preferably made from metal, as is ram 43. Further, mating surface 78 is preferably in positive metal-to-metal contact with a portion of the surface of the liner 58.

Still referring to FIG. 2, body 50 is disposed around lug adapter 54, ram 43, and locking member 48. Body 50 includes a lug 82 engaging lug adapter 54, is in sealing contact with ram 43, and engages the locking member 48. Further, body 50 includes an inner annular shoulder 84, a locking surface 86 having threads 88, a tool recess 90, a first fluid passage 92, and a second fluid passage 94. Shoulder 84 of body 50 is offset from shoulder 78 of ram 43, so that a chamber 96 is defined therebetween. Passage 92 extends through body 50 between its outer surface to its inner surface. Passage 92 includes an inner opening 98 and an outer portion 100. Inner opening 98 is in fluid communication with chamber 96 and outer portion 100 is adapted to receive a quick hose coupling 102, which is in turn attached to a pump (not shown). Second passage 94 is also in fluid communication with chamber 96 and is preferably positioned about 180 degrees from passage 92. Passage 94 is adapted to received a rupture disc 104. As mentioned below, threads 88 engage threads 106 of the locking member 48.

Chamber 96 is defined between shoulder 84 of body 50 and shoulder 56 of ram 43 and between slidable member 42 and body 50 and is adapted to receive retention hydraulic fluid, which may be pressurized by any suitable means, such as a hand pump. Seals 44, 46 prevent leakage of hydraulic fluid from chamber 96. Pressurization of the retention hydraulic fluid causes movement of slidable member 42 between the unsecured and secured positions. Locking member 48 has a locked and an unlocked position. In the locked position, the locking member 48 holds slidable member 42 in the secured position. When the slidable member 42 is in the secured position, a liner 58 in contact with slidable member 42 is held securely against the liner seal (not shown) between liner 58 and a wear plate (not shown). In addition to securing the liner 58, slidable member 42 energizes the liner seal as the liner 58 is compressed against the liner seal.

Still referring to FIG. 2, locking member 48 is in contact with slidable member 42. Locking member 48 preferably includes a surface 108, a boss 110, and external threads 106. Boss 110 extends radially from surface 108 of locking member 48. Threads 106 engage corresponding internal threads on the inner surface of body 50.

Lug adapter 54 is disposed around retention member 52. Lug adapter 54 preferably includes a substantially cylindrical threaded inner surface 112, a front face 114, a shoulder 116 and a first end 117. Inner surface 112 engages outer surface 118 of retention member 52, as shown. The front face 114 of lug adapter 54 is flush with the front face 70 of the retention member 52, preferably within 1/32 inch. A plurality of set screws 120, preferably four, are disposed circumferentially around lug adapter 54, so as to prevent movement of lug adapter 54 with respect to retention member 52. Each set screw 120 passes through lug adapter 54 and abuts the outer surface 118 of retention member 52.

Referring now to FIGS. 3A–B, lug adapter 54 preferably includes an outer profile 122, which corresponds to the inner profile 124 of lug 82. At least four profiles 142 are preferably arrayed circumferentially around the lug adapter 54. Each outer profile 122 preferably includes a recess 126 and a recess shoulder 128, and a channel 130. Each recess 126 and corresponding recess shoulder 128 are included within shoulder 116 of the lug adapter 54. Each recess 126 extends between a recess shoulder 128 and a channel 130. Each channel 130 extends from the shoulder 116 to the first end 117 of the lug adapter 54. Still referring to FIG. 3A, recess 90 is adapted to receive a T-handle tool 132.

Figure 4:
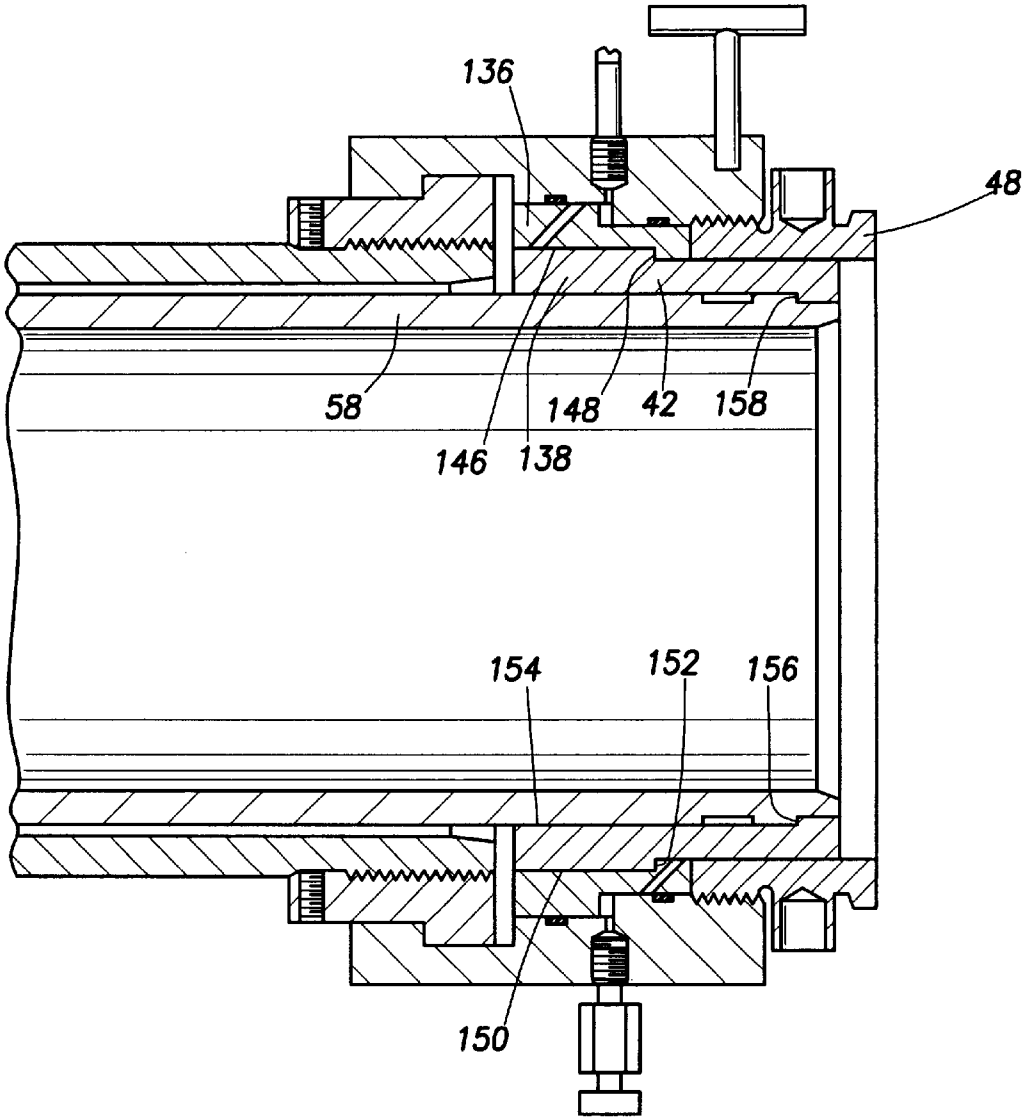
FIG. 4 is a cross-sectional view of another preferred hydraulic retention system.

Referring now to FIG. 4, in another preferred embodiment, slidable assembly 42 includes a ram 136 and a bushing 138. Bushing 138 is disposed between slidable assembly 42 and liner 58. Bushing 138 lines a portion of the inner surface of ram 136. Ram 136 includes an inner surface 146 that contacts bushing 140 and includes an annular shoulder 148. Bushing 138 includes an outer surface 150 having a shoulder 152. Bushing 138 further includes an inner surface 154 that includes at least one radial mating surface 156. Shoulder 148 of ram 136 bears on shoulder 152 of bushing 138, while mating surface 156 bears on corresponding mating surface 158 of liner 144. In this manner, bushing 140 is adapted to transmit a longitudinal force from ram 136 to liner 58. Mating surfaces 156,158 are preferably in positive metal-to-metal contact.

Upon pressurization of fluid disposed in chamber 96, slidable member 42 slides longitudinally between an unsecured position shown in FIGS. 2 and 4 and a secured position (not shown). In the secured position, the width of gap 68 is reduced and cylinder liner 58 is compressed against the liner seal.

The locking member 48 adjusts between an unlocked position, shown in FIGS. 2 and 4, and a locked position (not shown). When locking member 48 is in its unlocked position, slidable assembly 42 is free to slide between the unsecured and secured positions. When slidable assembly 42 is in its secured position, locking member 48 can be set in its locked position. When the locking member 48 is in the locked position, the fluid in chamber 96 can be depressurized and slidable assembly 42 is mechanically held in the secured position by the locking member 48. An advantage of the preferred embodiment is that locking member 48 can be adjusted by hand. Further, the present hydraulic retention system provides the advantage of installing and aligning the liner with a precise, circumferentially uniform hydraulic force and retaining the liner in secure alignment.

Referring to FIGS. 2 and 4, the present hydraulic retention system 40 operates as follows. When slidable member 42 begins in the unsecured position, application of pressure to the retention hydraulic fluid causes a longitudinal force to be applied to slidable member 42, compelling it toward to the pump module. The slidable member 42 in turn transmits a force to liner 58, compelling liner 58 towards the pump module. Locking member 48 can be rotated from the unlocked position to the locked position.

In the secured position, slidable member 42 applies a retaining force to the liner 58. When it is desired to release slidable member 42 from its secured position, an application of pressure to the retention fluid balances any return force from slidable member 42 against locking member 48, allowing locking member 48 to be rotated from the locked position to the unlocked position. As the fluid pressure in chamber 96 is released, the energy stored in the compressed liner 58, is transmitted to the slidable member 42, which in turns slides toward the locking member 48.

The hydraulic retention system is installed according to the following preferred method. The liner adapter is threaded into a pump module until mated against the counter bore of the pump module. The lug adapter is threaded onto the liner adapter until the face of the lug adapter is flush with the face of the liner adapter, preferably within 1/32 inch, and until the lug recess is in the top position. Set screws 120 are tightened, preferably to about 25 ft. pounds. Set screws prevent the lug adapter from rotating. The liner is installed with a gasket, with the gasket securely mated against the wear plate. The lug bushing 140 is installed onto the liner. The width of the gap between the back face 81 of the lug bushing 140 and the front face 114 of the lug adapter 54 is preferably from 1/8 to 3/16 inches. A hand pump is preferably connected to the quick connect before the hydraulic retention system is installed, to allow free movement of the ram. The hydraulic retention system is then installed onto lug bushing 140 and onto lug adapter 54. One lug is preferably aligned with the T-handle slot. The hydraulic retention system is pushed forward until the lug clears the lug recess. Then, the hydraulic retention system is rotated clockwise, approximately 25 degrees, until the lug stops against the lug recess shoulder, and preferably the T-handle is in the top position.

Preferably, the hydraulic retention system is operated according to the following method. For first time use, the air is purged from the hydraulic retention system. Preferably, purging is accomplished by removing the pipe plug while using a hand pump, until the hydraulic fluid is present. Then the pipe plug is reinstalled and tightened. The pipe plug is preferably tightened to about 15 ft. lbs. The hydraulic retention system is then ready for use. In use, the hydraulic retention system is pressured up to a rated system pressure of about 5000–10,000 psi. The rupture disk is preferably set for about 20% above the rated system pressure, within a tolerance of ±200 psi. If the hydraulic retention system is overpressured, the rupture disk will fail, causing pressure loss. Pressure is applied to the hydraulic retention system with any suitable pump. After the hydraulic retention system is pressurized, the ram slides until the back face of the ram contacts the front face of the lug adapter. Sliding of the ram imparts a force to the cylinder liner, compelling the cylinder liner toward the pumping module and compressing the cylinder liner against the gasket. Preferably, the force is imparted via the bushing. In particular, the ram imparts a force to the bushing and the bushing in turn imparts a force to the cylinder liner. Once the cylinder liner is held in place by the fluid pressure, the locking ring can be tightened snugly by hand. An advantage of the present preferred embodiment is the enablement of the hand tightening of the locking ring. After the locking ring has been tightened, the fluid pressure is released, and the quick connect hose fitting can be disconnected.

The hydraulic retention system is removed according to the following preferred method. The pump is preferably connected throughout the removal procedure to allow free movement of the ram. The hydraulic retention system is pressured up to a maximum of the rated system pressure. After the hydraulic retention system is pressurized up, the locking ring is loosened at least two complete turns. After the locking ring is loosened, fluid pressure is released. Optionally, the front face of the locking ring can be tapped with a soft face hammer, thus jarring the components loose. The hydraulic retention system is rotated by hand until the lug comes in contact with lug opening shoulder. The hydraulic retention system is then removed. The lug bushing is then removed.

It is understood that although the invention is described with particular reference to a pump piston used with slush or mud pumps, it will be recognized that the hydraulic rentention system may be used or adapted to use for retaining other mud pump parts, such as valve pot covers. Further, it will be recognized that mud pumps are exemplary of reciprocating or positive displacement pumps and certain features thereof may be used or adapted to use in other types of reciprocating pumps, such as reciprocating pumps used in mining operations, and the like.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the hydraulic retention system and apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. An apparatus for securing a removable part having an annular first shoulder to a pump module in a reciprocating pump, comprising:

a hydraulic body attached to said pump module, said body including a variable volume chamber adapted to receive hydraulic fluid;

a hydraulic ram mounted on said body and having an annular second shoulder engaging said annular first shoulder such that said ram imparts a force to said removable part upon pressurization of said fluid and upon said ram sliding inwardly toward said pump module.

2. The apparatus according to claim 1, wherein said body comprises an annular third shoulder and said ram comprises an annular fourth shoulder offset from said third shoulder, said third and fourth shoulders defining said hydraulic fluid chamber therebetween.

3. The apparatus according to claim 2, wherein said ram slides with respect to said body when said fluid is pressurized.

4. The apparatus according to claim 3, wherein said ram slides between a first position and a second position and wherein when said ram is in said first position said ram secures a liner to said module.

5. The apparatus according to claim 1, further comprising a locking member engaging said body.

6. The apparatus of claim 5, wherein said locking member is adjustable so as to secure said ram in said second position upon tightening of said locking member.

7. A hydraulic retention system for securing a cylinder liner to a pump module in a reciprocating pump, comprising:

a hydraulic body attached to said module;

a slidable member engaging the body and being slidable between a first position and a second position, said slidable member having a mating surface contacting said liner such that said slidable member, in said first position, imparts a securing force to said liner; and a locking member engaging said body and adapted to maintain said slidable member in said first position in the absence of hydraulic pressure.

8. The apparatus according to claim 7, wherein said surface extends radially, such that said force is substantially axial.

9. The apparatus according to claim 7, wherein said slidable member extends circumferentially around said liner.

10. The apparatus according to claim 7, wherein said slidable member includes an inner surface having a first diameter portion and a second diameter portion.

11. The apparatus according to claim 10, wherein said mating surface extends between said first diameter portion and said second diameter portion.

12. The apparatus according to claim 7, wherein said slidable member comprises a ram and optionally a bushing, wherein at least one of said ram and said bushing includes said mating surface.

13. The apparatus according to claim 7, wherein said locking member comprises a ring.

14. The apparatus according to claim 7, wherein said locking member has a first position, wherein said locking member in said first position contacts said slidable member in said secured position.

15. The apparatus according to claim 7, wherein said pump module comprises a retention sleeve and said body is attached to said retention sleeve.

16. The apparatus according to claim 15, wherein said body is attached to said retention sleeve with a lug adapter engaged with each of said body and said retention sleeve.

17. The apparatus according to claim 16, wherein said body comprises a lug engaging said lug adaptor.

18. An apparatus for use with hydraulic fluid for securing a cylinder liner comprising metal to a pump module in a reciprocating pump, comprising:

a slidable member having an annular cross-section and contacting a removable part;

a hydraulic body circumferentially extending around said slidable member and affixed to said pump module;

a locking member engaged within said body and having a first position and second position in contact with said slidable member in the absence of pressurization of said fluid;

wherein said slidable member and said hydraulic body define a space therebetween for receiving hydraulic fluid;

wherein said slidable member moves in response to pressurization of said fluid and comprises metal;

wherein said locking member is adjustable between said first and second positions upon movement of said slidable member;

wherein said slidable member comprises metal; and wherein said slidable member and said removable part are in positive metal to metal contact.

19. The apparatus according to claim 18, wherein said apparatus promotes alignment of said cylinder liner.

* * * * *